US005655204A

United States Patent [19]

Siegel

[11] Patent Number: 5,655,204

[45] Date of Patent: Aug. 5, 1997

[54] DUAL ESB CLEANER WITH ALTERNATING BIAS USING DUTY CYCLE CONTROL

[75] Inventor: Robert P. Siegel, Penfield, N.Y.

[73] Assignee: Xerox Corporation, Stamford, Conn.

[21] Appl. No.: 559,682

[22] Filed: Nov. 15, 1995

[51] Int. Cl.[6] ..... G03G 21/00

[52] U.S. Cl. ..... 399/349; 399/354

[58] Field of Search ..... 355/303, 301, 355/302, 297; 118/652; 430/125; 15/256.52, 1.51; 399/349, 354

[56] References Cited

U.S. PATENT DOCUMENTS

| | | | |
|---|---|---|---|
| 4,640,599 | 2/1987 | Doutney | 355/222 |
| 5,257,079 | 10/1993 | Lange et al. | 355/303 |
| 5,416,572 | 5/1995 | Kolb et al. | 355/301 X |
| 5,519,480 | 5/1996 | Thayer et al. | 355/301 |
| 5,559,593 | 9/1996 | Yoshinaga et al. | 355/297 X |

OTHER PUBLICATIONS

Lindblad et al.; "Dual Electrostatic Brush Cleaner for Cleaning Multiple Toner Types"; Xerox Disclosure Journal; vol. 15; No. 6; Nov./Dec.; 1990; pp. 463–466.

*Primary Examiner*—Arthur T. Grimley
*Assistant Examiner*—Sophia S. Chen
*Attorney, Agent, or Firm*—T. L. Fair

[57] ABSTRACT

An apparatus and method for cleaning particles from the imaging surface of the photoreceptor is by having a DC biased electrostatic brush remove the majority of the residual particles on the imaging surface with an AC biased brush as a follow-up for removal of residual particles. These particles have a predominant electrical polarity of right or wrong sign charge. The degree to which this AC biased brush removes each sign toner is controlled by the duty cycle. The responsibility of the first brush, in the direction of motion of the photoreceptor, is reduced by reducing the brush biases, the speed or the photoreceptor interference (BPI) of the first brush, in the direction of motion of the photoreceptor and allowing the second brush to take on higher percentage of the cleaning load. This enables longer brush life and reduces detoning stress. Alternatively, the second brush may increase in latitude, leaving the first brush parameters unchanged, enabling superior cleaning performance or reduced brush costs.

9 Claims, 3 Drawing Sheets

DUAL ESB CLEANER WITH ALTERNATING BIAS USING DUTY CYCLE CONTROL

BACKGROUND OF THE INVENTION

This invention relates generally to an electrophotographic printer or copier, and more particularly concerns a cleaning apparatus used therein.

There are electrophotographic printing machines which use a conductive brush with a negative DC (direct current) bias. Toner charged positively by the preclean dicorotron is thus cleaned by rotating the biased cleaner brush. Detoning of the brush is accomplished with detoning rolls and a flicker bar/vacuum system. This cleaner has difficulty cleaning wrong sign toner and wrong sign paper debris. Blade cleaners are used in many copiers but are not usually used in high volume machines due to their poor reliability. A high toner mass per unit area (M/A) entering the blade cleaner creates a stress input. It has been demonstrated that if the M/A could be reduced, cleaning could be performed at lower minimum blade loads. Additionally, on other machines it has been determined that comet formation (i.e. small deposits, usually consisting of toner and toner additives, which cannot be cleaned from a surface and can grow to a size which creates copy quality defects) on the photoreceptor was reduced by decreasing the blade load, which would be possible if the M/A was reduced. In multicolor copiers and printers of the future, it is important to provide the most robust cleaner designs to assure acceptable cleaning performance over the wide variety of materials and conditions that will be encountered. In an effort to achieve this robust cleaner, some work has been done with a single conductive brush with an AC electrical bias to allow cleaning of both polarity toners with the same brush. This single AC biased brush has been shown to work well on occasion, but frequently redeposition of toner from the brush to the photoreceptor surface (i.e. imaging surface) occurs after the cleaner brush has been used to clean toner from the photoreceptor surface.

Other machines have developed dual brush ESB (electrostatic brush) cleaners, where the first brush is negatively biased and the second brush is positively biased. This type of cleaner is a robust cleaner for two polarities of toner and debris where one brush picks up one polarity and the other brush picks up the opposite polarity. In multicolor copiers and printers of the future, it is important to provide the most robust cleaner designs to assure acceptable cleaning performance over the wide variety of materials and conditions encountered.

The following disclosures may be relevant to various aspects of the present invention and may be briefly summarized as follows:

U.S. Pat. No. 5,256,079 to Lange et al. discloses a cleaning brush electrically biased with an alternating current removes discharged particles from an imaging surface. The particles on the imaging surface are discharged by a corona generating device. A second cleaning device including an insulative brush, a conductive brush or a blade, located upstream of the first mentioned brush, in the direction of movement of the imaging surface, further removes redeposited particles therefrom.

U.S. Pat. No. 4,640,599 to Doutney discloses it has been found that applying an alternating charge to the cleaning brush of a xerographic printer of the reversal development type results in superior neutralization of the residual charge on the photoconductor. This has the advantage of achieving subsequent charging that is uniform.

Xerox Disclosure Journal, Vol. 15, No. 6, Nov./Dec. 1990, pages 463–466, entitled "Dual Electrostatic Brush Cleaner for Cleaning Multiple Toner Types" to Lindblad et al., discloses an improved cleaning arrangement in an electrophotographic device using toner types of different tribocharging characteristics, in which residual toner to be cleaned from a charge retentive surface is charged with a preclean charging arrangement, and removed from the surface with appropriately biased DC electrostatic brush cleaners.

SUMMARY OF INVENTION

Briefly stated, and in accordance with one aspect of the present invention, there is provided an apparatus for removing residual particles from an imaging surface, comprising: a housing defining an open ended chamber; means for discharging the particles on the imaging surface, the imaging surface having motion, the particles having a wrong sign and right sign charge; at least two means for cleaning, including a first cleaning means and a second cleaning means, for removing particles from the discharged particles from the imaging surface, the second cleaning means being located downstream from the first cleaning means, in a direction of motion of the imaging surface; and means for electrically biasing the second cleaning means with an alternating current.

Pursuant to another aspect of the present invention, there is provided a method for removing residual particles from an imaging surface, having motion, using at least two cleaning brushes including a first brush and a second brush, comprising: discharging the particles on the imaging surface, the particles having wrong sign and right sign charge; biasing the first brush with a direct current; biasing the second brush with an alternating current; and removing the discharged particles from the imaging surface using the first brush and the second brush, the second brush being located downstream from the first brush, in a direction of motion of the imaging surface.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 3:
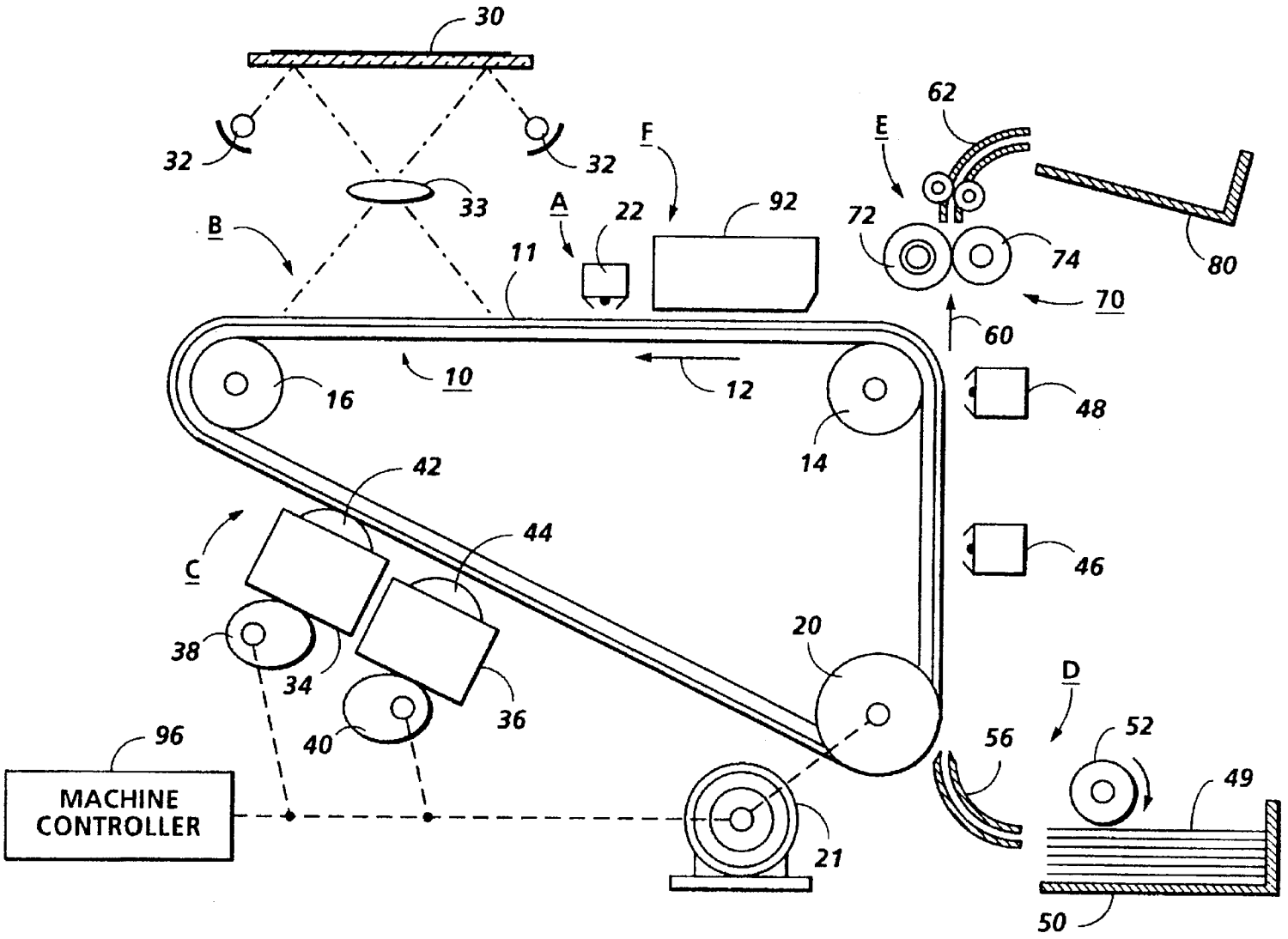
FIG. 3 is a schematic illustration of a printing apparatus incorporating the inventive features of the invention.

For a general understanding of an electrophotographic printer or copier in which the present invention may be incorporated, reference is made to FIG. 3 which depicts schematically the various components thereof. Hereinafter, like reference numerals will be employed throughout to designate identical elements. Although the dual electrostatic brush cleaner apparatus of the present invention is particularly well adapted for use in an electrophotographic printing machine, it should become evident from the following discussion, that it is equally well suited for use in other applications and is not necessarily limited to the particular embodiments shown herein.

Referring now to the drawings, the various processing stations employed in the reproduction machine illustrated in FIG. 3 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 3, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, the belt 10 advances the electrostatic latent image to development station C. At development station C, one of at least two developer housings 34 and 36 is brought into contact with the belt 10 for the purpose of developing the electrostatic latent image. Housings 34 and 6 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, a corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50 with sheet feeder 52, and advanced to transfer station D along conveyor 56.

After transfer, the sheet continues to move in the direction of arrow 60 to fusing station E. Fusing station E includes a fuser assembly, indicated generally by the reference numeral 70, which permanently affixes the transferred toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, may be removed at cleaning station F. The hybrid cleaner of the present invention is represented by the reference numeral 92. Removed residual particles may also be stored for disposal.

A machine controller 96 is preferably a known programmable controller or combination of controllers, which conventionally control all the machine steps and functions described above. The controller 96 is responsive to a variety of sensing devices to enhance control of the machine, and also provides connection of diagnostic operations to a user interface (not shown) where required.

Commonly, in a dual electrostatic brush (ESB) cleaner, each of the two brushes are provided a DC bias. The first brush is biased to attract toner from the photoreceptor of the dominant polarity. The second brush is reverse biased so as to attract the relatively small quantity of toner particles of opposite polarity commonly known as "wrong sign toner". Due to this arrangement, the first brush bears the majority of the work load, accumulates the most toner, and is the major driver for service actions which are required when the brush fills up with toner. In the present invention, the second brush receives an AC bias so as to pick up wrong sign toner with a portion of the duty cycle while the rest of the cycle can be used to remove dominant sign toner from the photoreceptor thus reducing the load on the first brush. (An AC biased brush can pick up both polarities of toner whereas a DC biased brush cannot.)

Figure 1:
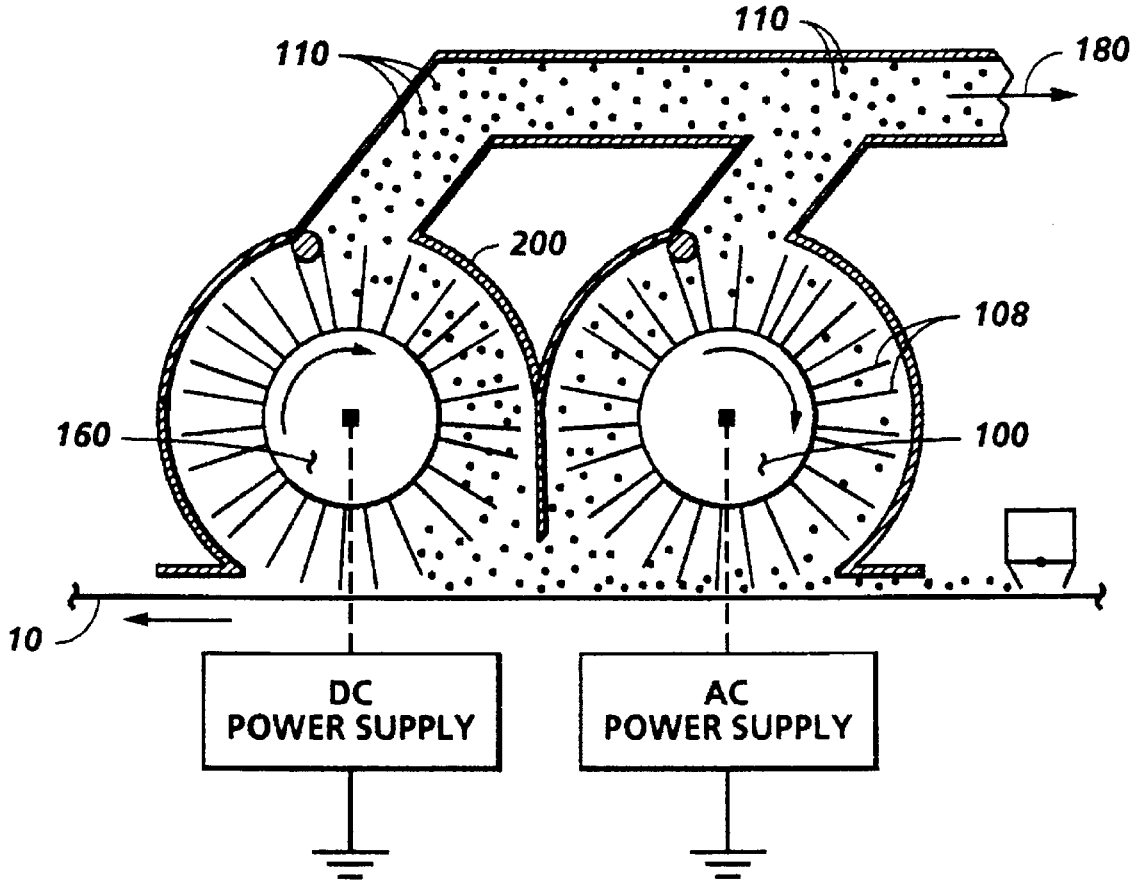
FIG. 1 is a schematic elevational view of the present invention.

Reference is now made to FIG. 1, which shows a schematic elevational view of the present invention. In the present invention, the second (or follow-up) brush, located downstream from the first brush in the direction of motion of the photoreceptor 10, receives an alternating current (AC) bias administered in such a way that an adequate portion of its duty cycle is allocated for the removal of wrong sign toner, while the remaining portion of the duty cycle can be reallocated to the removal of right sign toner. (This is shown graphically in FIG. 2B.) A similar type of duty cycle is required to be applied to the detoning roll (DTR) 150, 170 with the appropriate phase relationship to account for the displacement of the detoning nip (brush to DTR) from the cleaning nip (brush to photoreceptor).

With continuing reference to FIG. 1, the primary cleaner is an electrostatic brush 100 with a DC (direct current) bias followed by an AC (alternating current) biased brush 160 as a secondary cleaner. The first brush 100, of the dual brush configuration, is DC biased and cleans the bulk (i.e. majority) of the toner 110. The second brush 160 is biased with an AC bias with a low enough frequency (e.g. 5–50 Hz) to reduce and/or prevent redeposition by the AC brush on the imaging surface. The alternating current bias of the present invention, is applied at a relatively high bias frequency (50 Hz–500 Hz as compared to the brush rotational frequency 0.5 Hz–5 Hz) to enable a duty cycle capable of picking up small quantities of wrong sign toner as well as potentially significant quantities of right sign toner. While a vacuum 180 is not required in the present invention, one is shown. The vacuum 180 generates an air flow that pulls the toner particles 110 from the brush fibers 108, out of the housing 190, and deposits these toner particles and other waste material cleaned from the photoreceptor surface into a waste container (not shown).

Figure 2A:
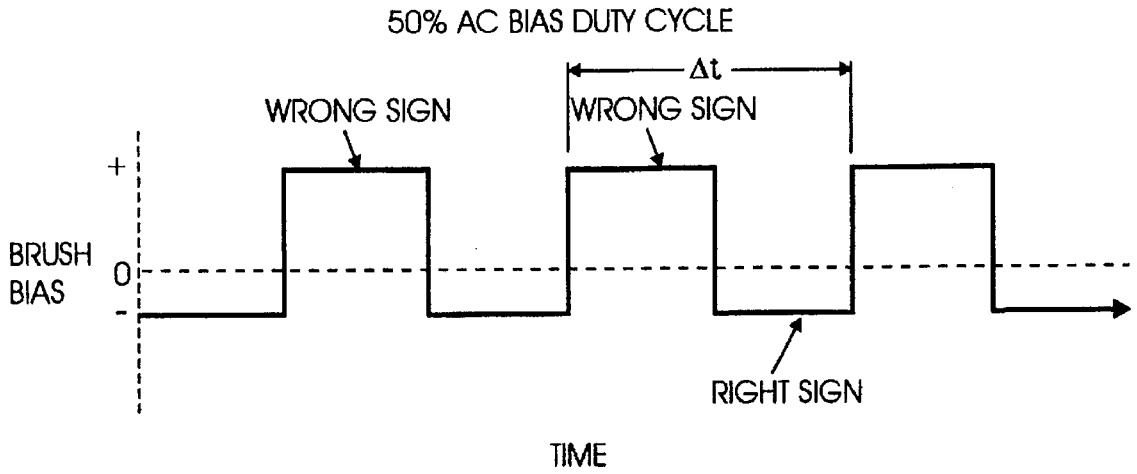
FIGS. 2A and 2B are graphical illustrations of the AC brush bias vs. time duty cycle.
Figure 2B:
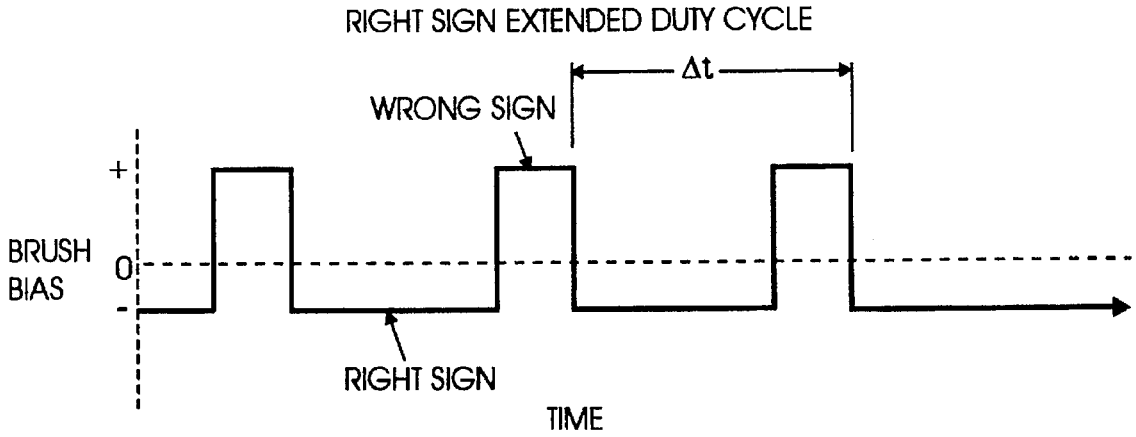

Referring now to FIGS. 2A and 2B which graphically illustrate AC brush bias vs. time ($\Delta t$) for the duty cycle. In FIGS. 2A and 28, the right sign toner is positive (+) and the wrong sign toner is negative (–). $\Delta t$ is defined as the time it takes for a point to move through the contact zone (i.e. nip—where the brush and photoreceptor are in contact). FIG. 2A shows a standard AC biased brush 50% duty cycle. In this standard 50% duty cycle, the wrong sign (–) toner is cleaned during the half of the duty cycle when the AC brush bias is positive (+) and the right sign (+) toner is cleaned during the other half of the duty cycle when the AC bias on the brush is negative (–). In FIG. 2B, an example of an AC duty cycle that better utilizes the capacity of the second AC brush, as in the present invention, is shown using the same $\Delta t$ of FIG. 2A. FIG. 2B shows how, in the present invention, only a small portion of the AC biased brush duty cycle is used to clean wrong sign (–) toner, while the remainder of the duty cycle uses the excess capacity of the underutilized AC brush to assist the first brush cleaner in removal of the right sign (+) toner.

Referring once again to FIG. 1, the dual brushes 100, 160 are separated by a housing 200 to prevent shorting (i.e. causing loss or altering of toner charge) and air-breakdown failures (i.e. too high of a voltage occurs on the brush) due to contact between the AC and DC biased brushes 160, 100. The high mass cleaning of the first brush 100 results in a low mass input to the second brush 160, thus, reducing the possibility of toner emissions from that side of the cleaner containing the second brush 160. Also, the low mass input into the second (AC biased) brush 160 reduces redeposition by the AC biased brush. The brushes 100, 160 are shown as rotating in opposite directions to one another by arrows 161, 101. However, the direction of rotation of the brushes is not limited to this direction shown relative to each other nor relative to the direction of motion of the photoreceptor. For example, the brushes can be rotated in the same direction as the other brush and with or against the photoreceptor direction of movement.

An advantage of the present invention is that the first brush, located upstream from the second brush in the direction of motion of the photoreceptor, is relieved of the full responsibility for cleaning the dominant sign toner. If, for example, the AC brush in the secondary position removes about 20% of the dominant sign toner, then the DC biased first brush is required to clean only about 80% rather than 100% of the dominant toner, which would extend the service interval for the cleaner by roughly 20%. This advantage is achieved by reducing the brush biases, the speed or the photoreceptor interference (BPI) of the first brush. Reducing BPI also reduces the torque required to drive the photoreceptor 10 which is a significant cost driver in the selection of a motor. Reducing speed or bias reduces power consumption which is another benefit of the present invention.

An alternative embodiment would be to change the contribution of second brush, leaving the first brush unchanged, by increasing the latitude of the second brush which may, for example, enable CQ (i.e. copy quality) patches to be removed in a single pass or extend the useful life of brushes which have become worn or set.

The key enabler would be to ensure an adequate speed differential between the cleaning brush and the photoreceptor belt thus allowing each portion of the photoreceptor belt to be treated with both bias polarities before passing through the contact zone. Implementation would require a power supply capable of providing an alternating bias voltage with the appropriate frequency, amplitude and rise time. A corresponding AC bias would also be applied to the detoning roll with an added phase shift to account for the time lag between the belt contact zone and detoning contact zone.

Alternate embodiments of the present invention include using information about the state (i.e. condition) of the cleaner or about the current cleaning job to create an intelligent cleaner. This could be done by dynamically changing the duty cycle of the second (i.e. AC biased) brush in response to either a stress input such as a CQ patch (i.e. solid area test) or a paper jam or, in response to an indication that the first DC biased brush was not cleaning as well as it should, either through a background sensor or a type of end of life indication such as a copy count. In either case, increasing the percentage of the duty cycle to be dedicated to assisting the first brush reduces the relative importance of wrong sign toner in that situation.

Another improvement of the present invention, is an improvement in detoning efficiency of the cleaning brushes. Current DESB (dual electrostatic brushes) cleaning technology cannot achieve perfect (100%) detoning efficiency without the addition of an expensive vacuum system. This means that the brush will eventually accumulate enough toner that it will begin to redeposit onto the photoreceptor unless it is cleaned by a technician or replaced. As more compact products require DESB cleaners, smaller brushes will be required, which cause an increased demand on detoning efficiency since smaller brushes will fill up more rapidly than large brushes. With this in mind, improved detoning performance is necessary. The stress is almost entirely on the first brush in a DESB cleaning system since the first brush (upstream from the second brush in the direction of motion of the photoreceptor) is responsible for attracting the dominant sign toner. The second brush is primarily dedicated to removing wrong sign toner, although it may clean a small amount of right sign toner or neutral toner through strictly mechanical means. In the present invention, reducing the energy parameters (i.e. load, bias, speed) of the first brush (DC biased) and offloading more of the work to the second brush (AC biased) the detoning stress is spread more evenly between the two cleaning brushes.

In recapitulation, the preferred method of cleaning particles from the imaging surface of the photoreceptor is by having a DC biased electrostatic brush remove the majority of the residual particles on the imaging surface with an AC biased brush as a follow-up for removal of residual particles. The degree to which this AC biased brush removes each sign toner is controlled by the duty cycle. The responsibility of the first brush, located upstream from the second brush in the direction of motion of the photoreceptor, is reduced by reducing the brush biases, the speed or the photoreceptor interference (BPI) of the first brush and, allowing the second brush to take on higher percentage of the cleaning load. This enables longer brush life and also reduces detoning stress. Alternatively, the second brush may increase the overall system latitude, leaving the first brush parameters unchanged, enabling superior cleaning performance or reduced brush costs.

It is, therefore, apparent that there has been provided in accordance with the present invention, a dual ESB cleaner with a secondary cleaner, located downstream from the primary cleaner in the direction of motion of the photoreceptor, that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing residual particles from an imaging surface, comprising:

a housing defining an open ended chamber; means for discharging the particles on the imaging surface, the imaging surface having motion, the particles having wrong sign and right sign charge;

at least two means for cleaning, including a first cleaning means and a second cleaning means, for removing the discharged particles from the imaging surface, said second cleaning means being located downstream from said first cleaning means, in a direction of motion of the imaging surface;

means for electrically biasing said second cleaning means with an alternating current, the alternating current of said second cleaning means comprises a duty cycle having variability said second cleaning means having the ability of being capable of removing the particles having wrong sign and right sign charge by controlling the duty cycle of the alternating current, the duty cycle being extended for removing the particles having right sign with the alternating current;

said discharging means includes a corona generating device located upstream of said cleaning means in the direction of motion of the imaging surface;

means for electrically biasing said first cleaning means with a direct current.

2. An apparatus as recited in claim 1, wherein said second cleaning means comprises a second brush being rotatably mounted in the chamber of said housing.

3. An apparatus as recited in claim 2, wherein said first cleaning means comprises a first brush being rotatably mounted in the chamber of said housing.

4. An apparatus as recited in claim 3, wherein said second brush, being AC biased, having a low frequency of from about 5 hertz to about 50 hertz to prevent redeposition of the particles from the second brush onto the imaging surface.

5. An apparatus as recited in claim 3, wherein said second brush rotates in a direction opposite that of said first brush.

6. An apparatus as recited in claim 3, wherein said second brush rotates in a same direction as that of said first brush.

7. An apparatus as recited claim 3, further comprising a means, connected to said housing, for generating an air flow that forces the particles away from said first brush and said second brush toward an outlet from said housing.

8. A method for removing residual particles from an imaging surface having motion, using at least two cleaning brushes including a first brush and a second brush, comprising:

discharging the particles on the imaging surface, the particles having wrong sign and right sign charge;

biasing the first brush with a direct current;

biasing the second brush with an alternating current comprising the step of removing the particles having wrong sign and right sign charge by controlling the duty cycle, having variability, of the alternating current, the duty cycle being extended for removing the particles having right sign with the alternating current; and removing the discharged particles from the imaging surface using the first brush and the second brush, the second brush being located downstream from the first brush, in a direction of motion of the imaging surface.

9. A method as recited in claim 8, further comprising the step of applying a frequency of from about 5 hertz to about 50 hertz to the second brush to prevent redeposition of the particles from the second brush onto the imaging surface.

* * * * *